US009599962B1

(12) United States Patent
Erickson

(10) Patent No.: US 9,599,962 B1
(45) Date of Patent: Mar. 21, 2017

(54) TIMEPIECE WITH ALTERNATING COLOR ROTATING DIAL

(71) Applicant: Nathan J. Erickson, Seattle, WA (US)

(72) Inventor: Nathan J. Erickson, Seattle, WA (US)

( * ) Notice: Subject to any disclaimer, the term of this patent is extended or adjusted under 35 U.S.C. 154(b) by 0 days.

(21) Appl. No.: 15/260,369

(22) Filed: Sep. 9, 2016

(51) Int. Cl.
*G04B 19/06* (2006.01)

(52) U.S. Cl.
CPC ..... *G04B 19/06* (2013.01)

(58) Field of Classification Search
CPC ..... G04B 19/00; G04B 19/202; G04B 19/26; G04B 19/046
See application file for complete search history.

(56) References Cited

U.S. PATENT DOCUMENTS

| | | | | |
|---|---|---|---|---|
| 2,011,517 A | | 8/1935 | Geoffrion | |
| 2,255,188 A | | 9/1941 | Rieper | |
| 2,785,530 A | | 3/1957 | Mayer | |
| 4,939,708 A | | 7/1990 | Pincemy | |
| 5,662,479 A | | 9/1997 | Rogers | |
| 5,751,663 A | * | 5/1998 | Johnson | G04B 19/046 368/233 |
| 6,017,127 A | * | 1/2000 | Kurple | G01D 11/28 362/23.01 |
| 6,683,821 B1 | | 1/2004 | Emtyazi | |
| 7,440,358 B2 | | 10/2008 | Lassalle | |
| D686,093 S | * | 7/2013 | Wright | D10/40 |
| 2008/0084792 A1 | * | 4/2008 | Hayashi | G04C 3/14 368/80 |
| 2011/0317525 A1 | * | 12/2011 | Sawada | G04B 19/02 368/80 |
| 2014/0029387 A1 | * | 1/2014 | Matsuo | G04G 9/00 368/37 |
| 2015/0168178 A1 | * | 6/2015 | Hoover | G01D 5/245 368/321 |

* cited by examiner

*Primary Examiner* — Sean Kayes
(74) *Attorney, Agent, or Firm* — Donald J. Ersler

(57) ABSTRACT

A timepiece with alternating color rotating dial preferably includes a timepiece housing, at least one mounting plate, a hubbed spiral disc, a hubbed drive system, a geared spiral disc, an outside drive system, a clock module and a control module. The at least one mounting plate is attached to the timepiece housing. The hubbed drive system preferably includes a hubbed motor, a hubbed drive gear and a central gear. The hubbed drive system rotates the hubbed spiral disc. The outside drive system preferably includes an outside motor, at least one outside drive gear and an outside double-wide drive gear. The outside drive system rotates the geared spiral disc. The geared spiral disc rotates within the hubbed spiral disc. The control module controls the rotation of the geared spiral disc relative to the hubbed spiral disc.

20 Claims, 7 Drawing Sheets

TIMEPIECE WITH ALTERNATING COLOR ROTATING DIAL

BACKGROUND OF THE INVENTION

1. Field of the Invention

The present invention relates generally to timepieces and more specifically to a timepiece with alternating color rotating dial, which may be set to indicate that an adjustable period of time has transpired every time the dial makes a complete revolution.

2. Discussion of the Prior Art

U.S. Pat. No. 2,011,517 to Geoffrion discloses a clock dial. U.S. Pat. No. 2,255,188 to Rieper discloses a measuring instrument for aircraft. U.S. Pat. No. 2,785,530 to Mayer discloses a disk time indicating device. U.S. Pat. No. 4,939,708 to Pincemy discloses a timepiece of the analog type. U.S. Pat. No. 5,662,479 to Rogers discloses an apparatus and method to aid in the teaching of the concept of time. U.S. Pat. No. 6,683,821 to Emtyazi discloses a day and night depicting clock device. U.S. Pat. No. 7,440,358 to Lassalle discloses a visual indicating device.

Accordingly, there is a clearly felt need in the art for a timepiece with alternating color rotating dial, which may be set to indicate that an adjustable period of time has transpired every time the dial makes a complete revolution.

SUMMARY OF THE INVENTION

The present invention provides a timepiece with alternating color rotating dial, which may be set to indicate that an adjustable period of time has transpired. The timepiece with alternating color rotating dial (timepiece with rotating dial) preferably includes a timepiece housing, at least one mounting plate, a hubbed spiral disc, a hubbed drive system, a geared spiral disc, an outside drive system, a clock module and a control module. The timepiece housing includes a peripheral flange for retaining a retention ring. The timepiece housing is preferably self-supporting. The at least one mounting plate includes a clock mounting plate, an outside motor mounting plate and a base mounting plate. The base mounting plate is attached to the retention ring. The clock mounting plate and the outside motor mounting plate are attached to the base mounting plate. The clock module is attached to the clock mounting plate. The hubbed drive system preferably includes a hubbed motor, a hubbed drive gear and a central gear. The hubbed motor is attached to clock mounting plate. The outside drive system preferably includes an outside motor, at least one outside drive gear and an outside double-wide drive gear. The outside motor is attached to the outside motor mounting plate.

The hubbed drive gear is attached to a drive shaft of the hubbed motor. The central gear is retained on the hubbed spiral disc and is driven by the hubbed drive gear. A first outside drive gear is attached to a drive shaft of the outside motor. A second outside drive gear and the outside double-wide drive gear are rotatably retained between the outside motor plate and the base mounting plate. The second outside drive gear includes a second outside large gear and a second outside small gear. The geared spiral disc includes a geared outer perimeter. The first outside drive gear drives the second outside small gear. The second outside large gear drives the outside double-wide drive gear. The outside double-wide drive gear drives the geared outer perimeter of the geared spiral disc. The clock module drives a minute hand and an hour hand. The hubbed spiral disc includes a hubbed slit and the geared spiral disc includes a gear slit.

The hubbed and gear slits allow the geared spiral disc to rotate within the hubbed spiral disc. An outside gear magnet is attached to geared spiral disc, adjacent an outer perimeter thereof. An inside magnet is attached to the central gear, adjacent an outer perimeter thereof. An outside sensor is attached to the base mounting plate. An inside sensor is attached to the clock mounting plate. The control module may be programmed to control a speed of the hubbed and geared spiral discs, such that an adjustable period of time is created between the rotation of the hubbed spiral disc relative to the geared spiral disc.

Accordingly, it is an object of the present invention to provide a timepiece with rotating dial, which may be set to indicate that an adjustable period of time has transpired every time the dial makes a complete revolution.

These and additional objects, advantages, features and benefits of the present invention will become apparent from the following specification.

DETAILED DESCRIPTION OF THE PREFERRED EMBODIMENTS

Figure 1:
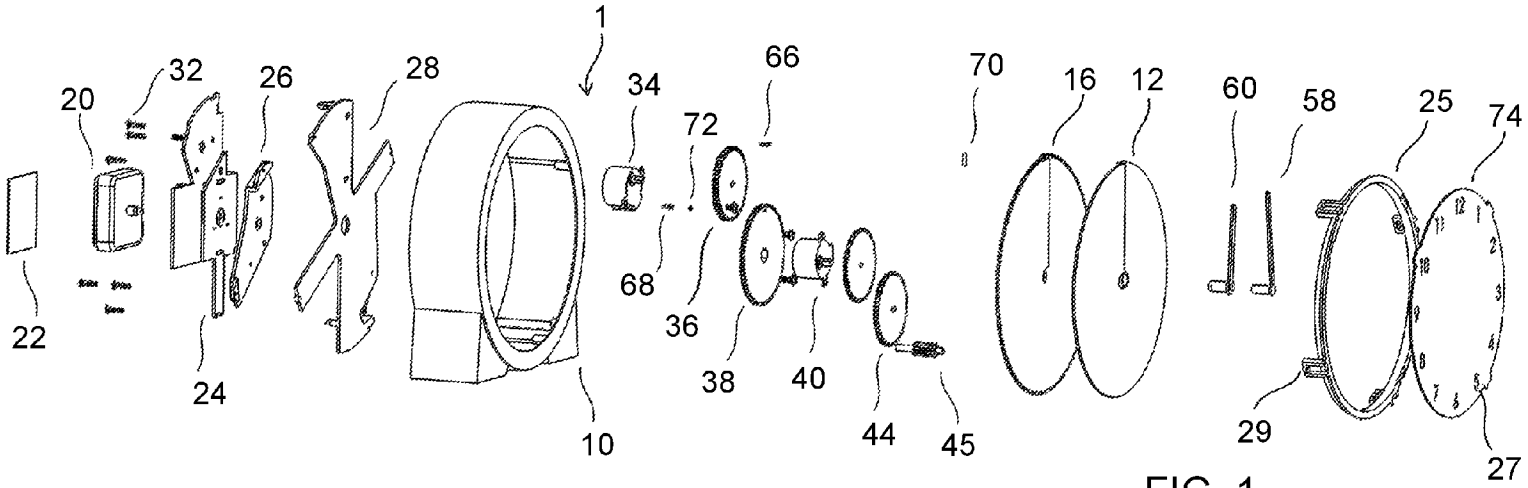
FIG. 1 is an exploded perspective view of a timepiece with rotating dial in accordance with the present invention.
Figure 2:
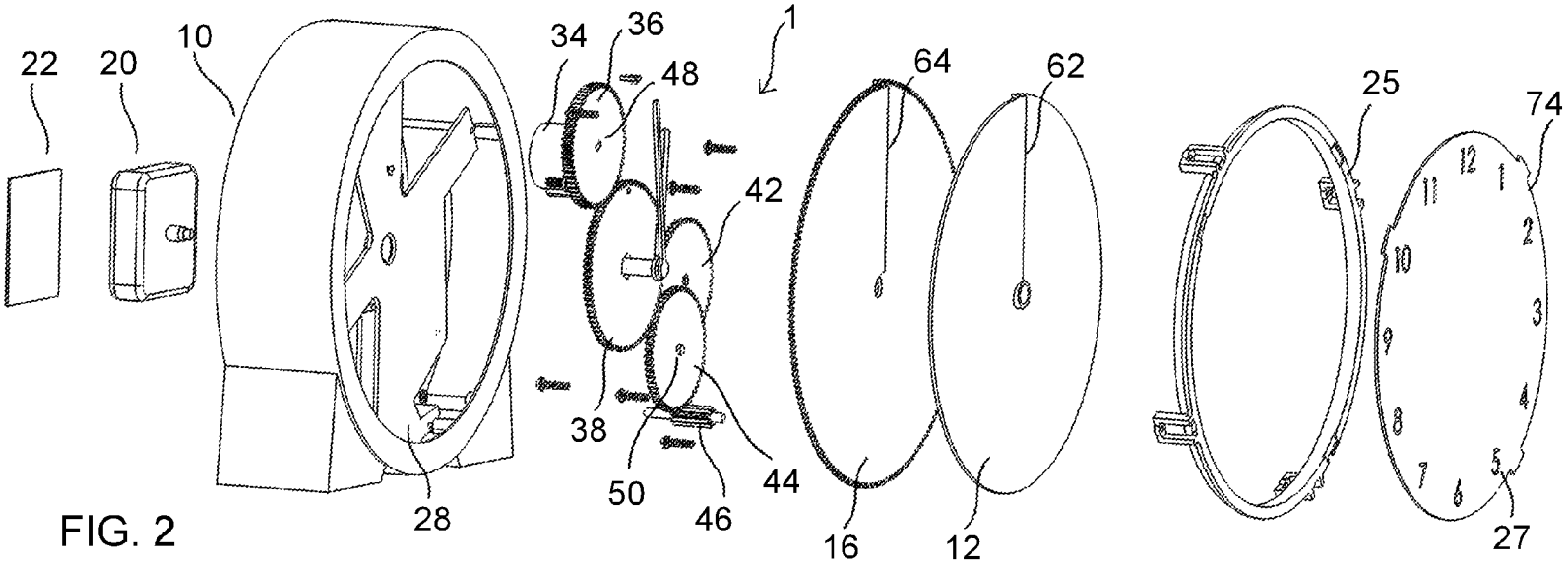
FIG. 2 is a partially exploded perspective view of a timepiece with rotating dial in accordance with the present invention.
Figure 3:
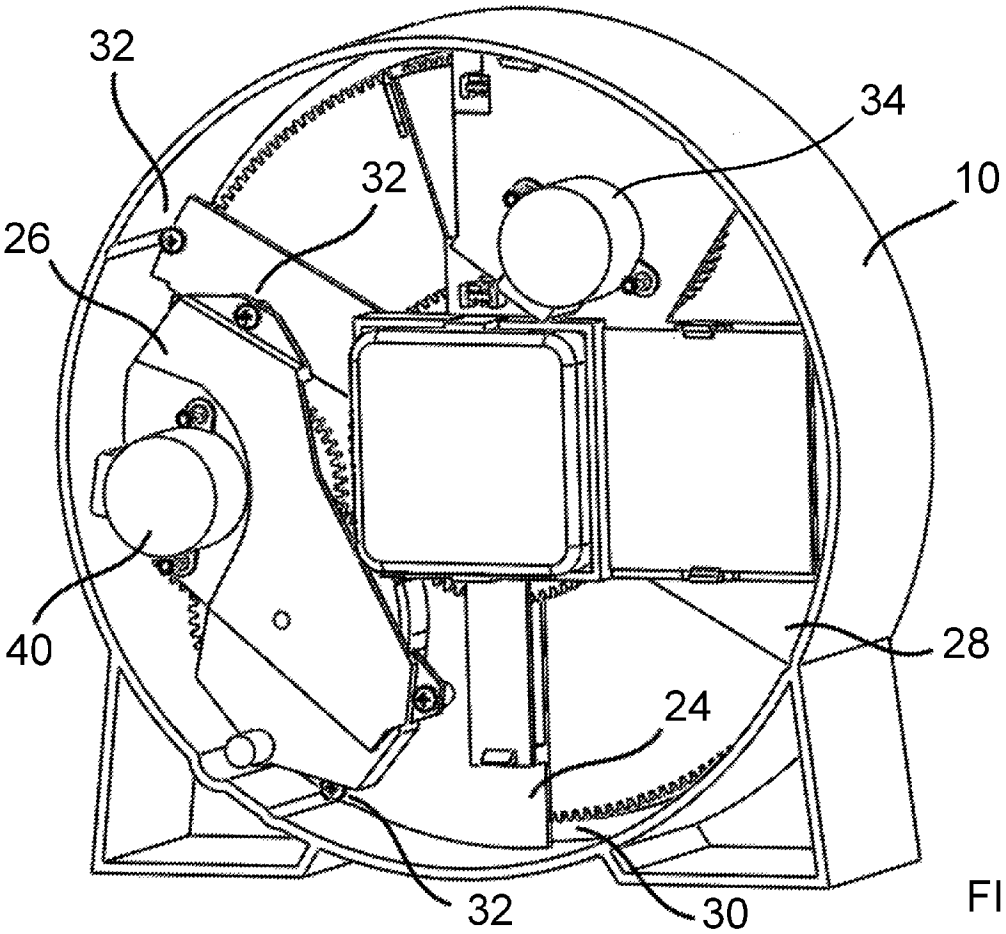
FIG. 3 is a rear perspective view of a timepiece with rotating dial in accordance with the present invention.

With reference now to the drawings, and particularly to FIG. 1, there is shown an exploded perspective view of a timepiece with rotating dial 1. With reference to FIG. 2, the timepiece with rotating dial 1 preferably includes a timepiece housing 10, at least one mounting plate, a hubbed spiral disc 12, a hubbed drive system 14, a geared spiral disc 16, an outside drive system 18, a clock module 20 and a control module 22. The at least one mounting plate includes a clock mounting plate 24, an outside motor mounting plate 26 and a base mounting plate 28. With reference to FIG. 3, the timepiece housing 10 includes a peripheral flange 30 for retaining a retention ring 25 and a clear cover disc 27. The retention ring 25 includes a plurality of thread bosses 29. The base mounting plate 28 is preferably attached to the plurality of thread bosses 29 of the retention ring 25 with a plurality of fasteners 32. The clock mounting plate 24 and the outside motor mounting plate 26 are preferably attached to the base mounting plate 28 with the fasteners 32. The clock module 20 is attached to the clock mounting plate 24. The timepiece housing 10 is preferably self-supporting.

Figure 4:
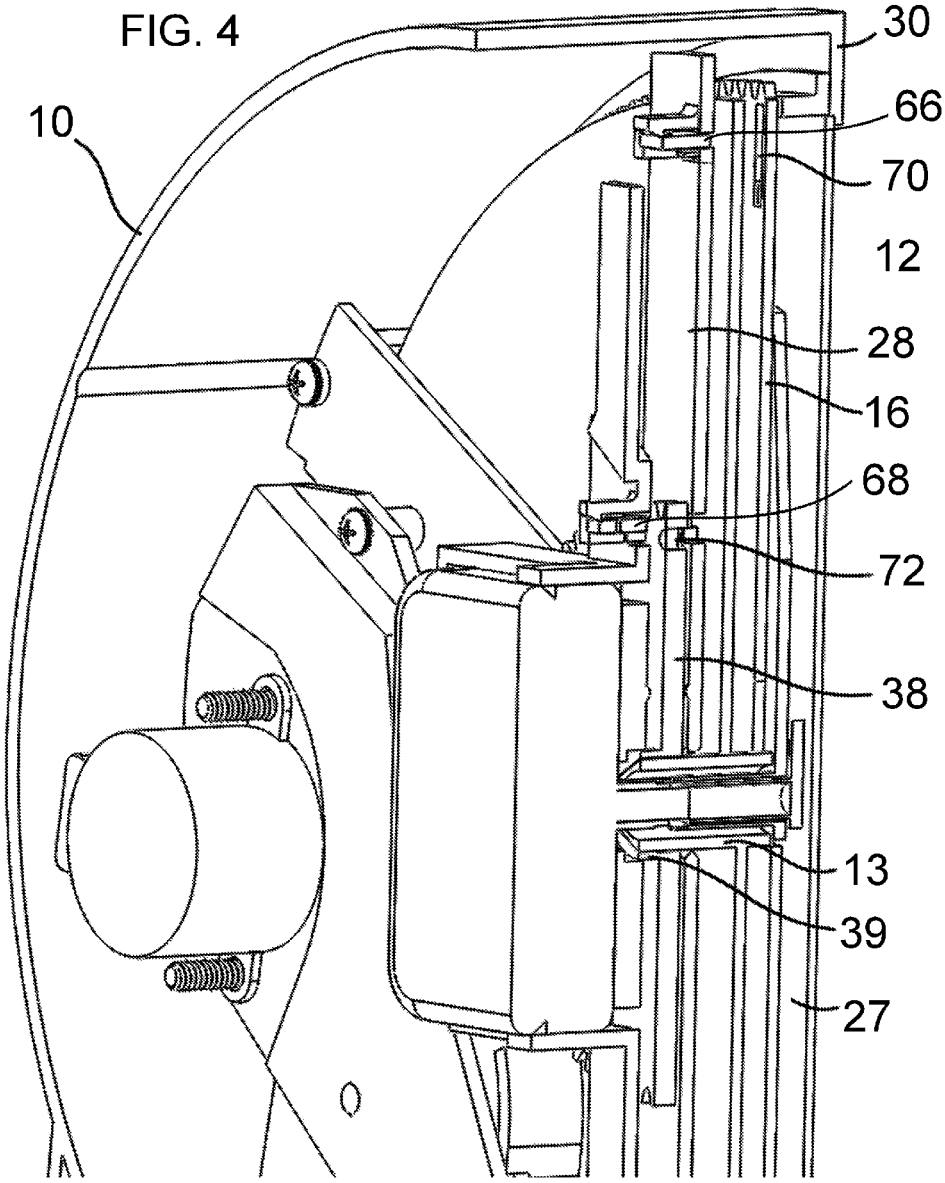
FIG. 4 is a partial rear perspective sectional view of a timepiece with rotating dial in accordance with the present invention.
Figure 5:
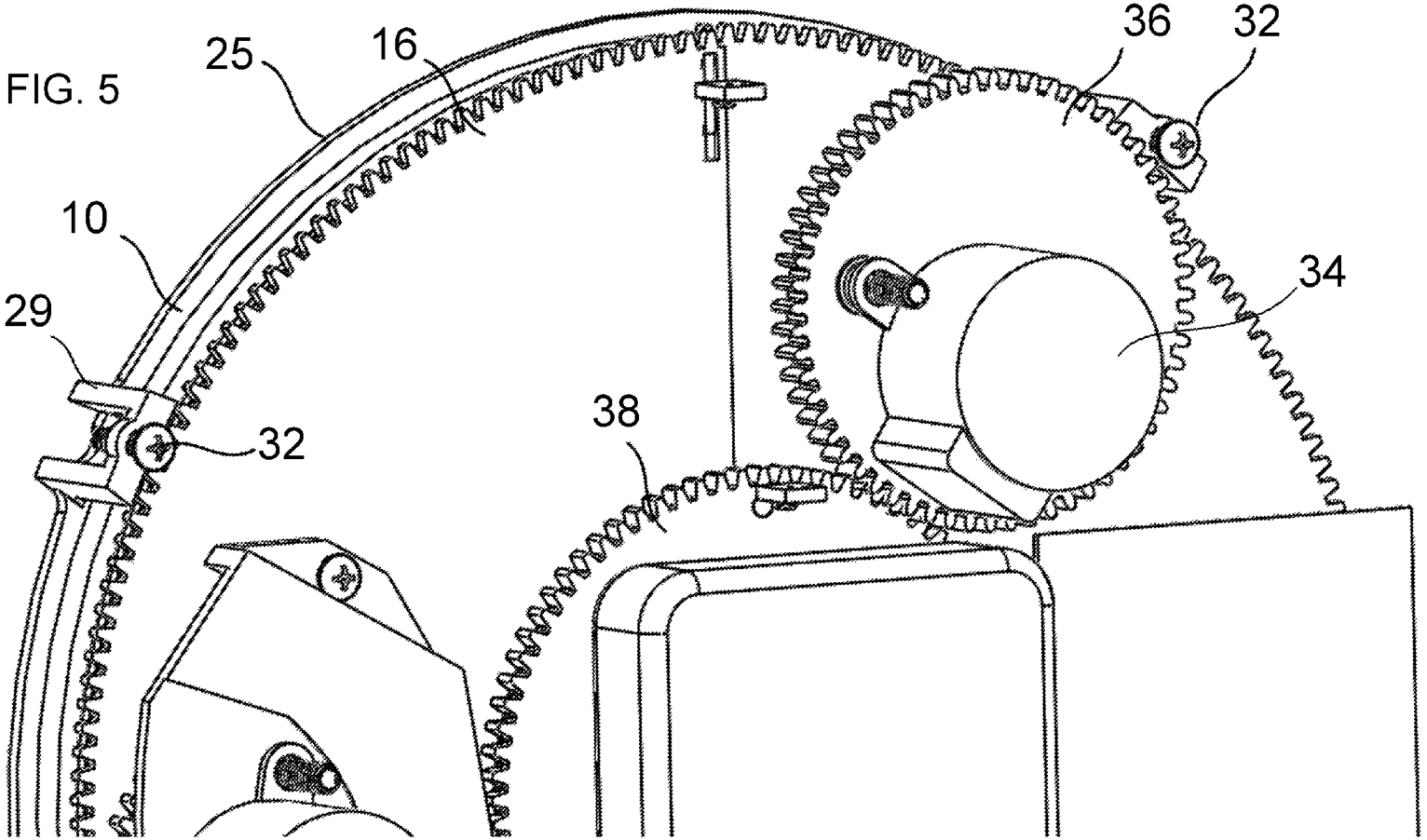
FIG. 5 is a partial rear perspective view of a portion of a timepiece with rotating dial illustrating a hubbed drive system with mounting plates removed in accordance with the present invention.
Figure 6:
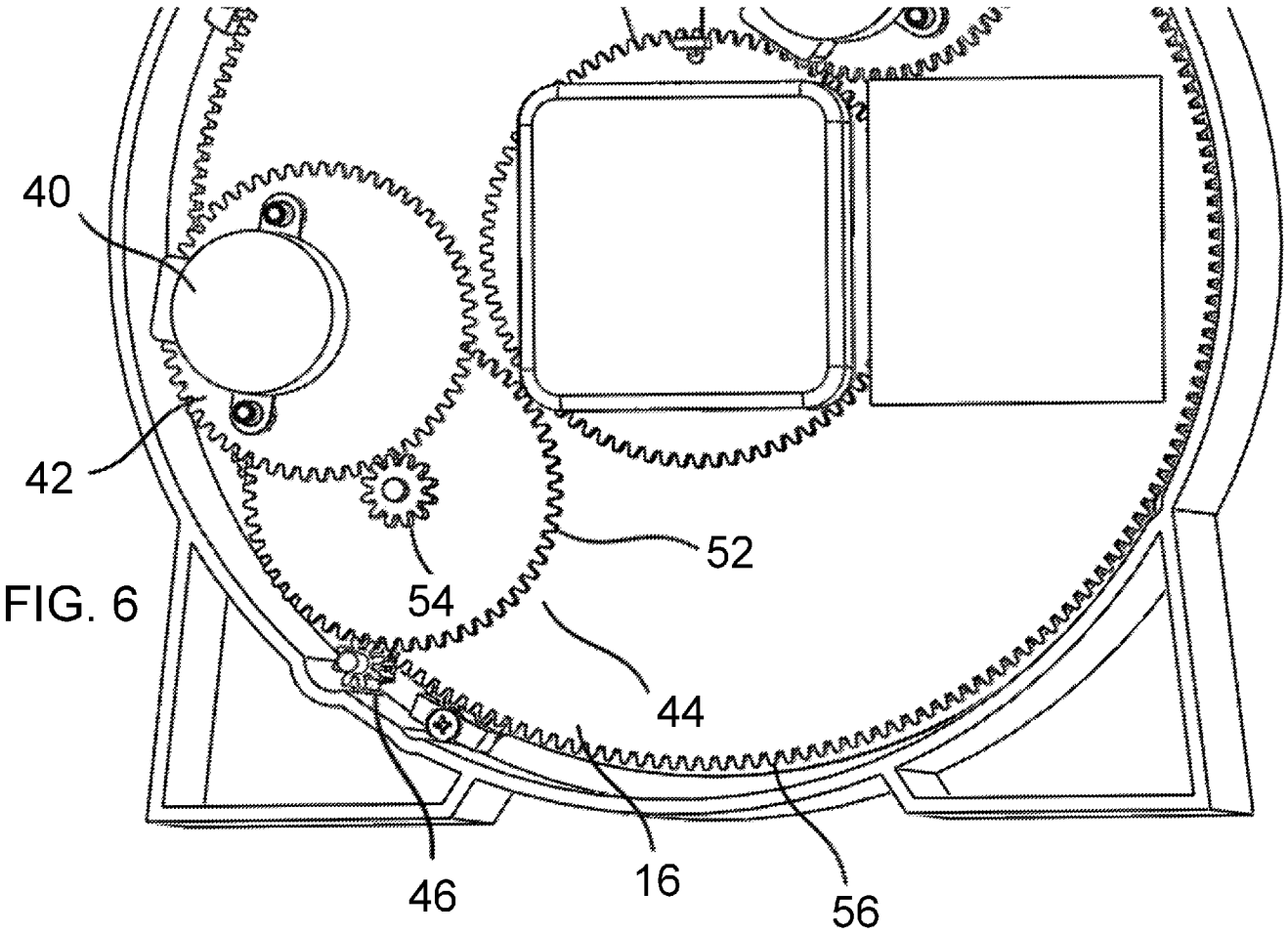
FIG. 6 is a partial rear perspective view of a portion of a timepiece with rotating dial illustrating an outside drive system with mounting plates removed in accordance with the present invention.

The hubbed drive system 14 preferably includes a hubbed motor 34, a hubbed drive gear 36 and a central gear 38. The hubbed motor 34 is attached to the clock mounting plate 24. The hubbed motor 34 is attached to clock mounting plate 24. The outside drive system 18 preferably includes an outside motor 40, a first outside drive gear 42, a second outside drive gear 44 and an outside double-wide drive gear 46. The outside motor 34 is attached to the outside motor mounting plate 26. With reference to FIGS. 2 and 5, the hubbed drive gear 36 is attached to a drive shaft 48 of the hubbed motor 34. With reference to FIG. 4, a retention hub 13 extends from a rear of the hubbed spiral gear 12. The retention hub 13 is pressed into a cylindrical boss 39 of the central gear 38. The hubbed drive gear 36 drives the central gear 38. A first outside drive gear 42 is attached to a drive shaft 50 of the outside motor 40. A second outside drive gear 44 and the outside double-wide drive gear 46 are pivotally retained between the outside motor mounting plate 26 and the base mounting plate 28. With reference to FIG. 6, the second outside drive gear 44 includes a second outside large gear 52 and a second outside small gear 54. The geared spiral disc 16 includes a geared outer perimeter 56. The first outside drive gear 44 drives the second outside small gear 54. The second outside large gear 52 drives the outside double-wide drive gear 46. The outside double-wide drive gear 46 drives the geared outer perimeter 56 of the geared spiral disc 16.

Figure 7:
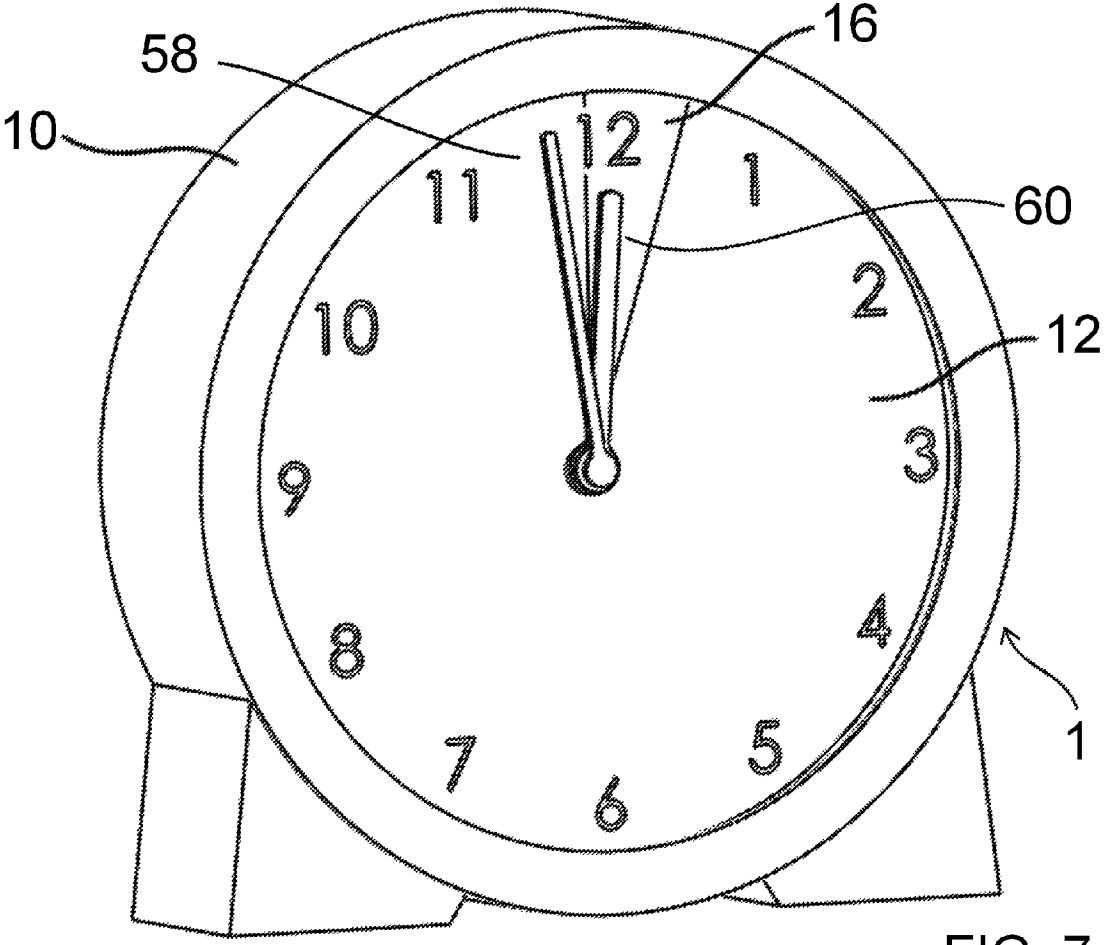
FIG. 7 is a front perspective view of a timepiece with rotating dial without a clear disc in accordance with the present invention.

The clock module 20 drives a minute hand 58 and an hour hand 60 to display time. The hubbed spiral disc 12 includes a hubbed slit 62 and the geared spiral disc 16 includes a gear slit 64. The hubbed slit 62 is inserted into the geared slit 64, such that the geared spiral disc 16 rotates relative to the hubbed spiral disc 12 on the same axis. With reference to FIG. 7, the hubbed and gear slits 62, 64 allow the geared spiral disc 16 to rotate within the hubbed spiral disc 12. With reference to FIG. 4, an outside gear magnet 66 is attached to the geared spiral disc 16, adjacent an outer perimeter thereof. An inside magnet 68 is attached to the central gear 44, adjacent an outer perimeter thereof. An outside sensor 70 is retained in the base mounting plate 28. An inside sensor 72 is retained in the clock mounting plate 24. The inside and outside sensors 70, 72 are preferably hall effect sensors. When the geared spiral disc 16 rotates the outside magnet 66 to a 12:00 position, the outside sensor 70 senses the outside magnet 66 and communicates with the control module 22. The control module 22 no longer supplies electrical power to the outside motor 40 and starts supplying electrical power to the hubbed motor 34. The hubbed motor 34 starts driving the hubbed spiral disc 12 through the central gear 38. When the hubbed spiral disc 12 rotates the inside magnet 68 to a 12:00 position, the inside sensor 72 senses the inside magnet 68 and communicates with the control module 22. The control module 22 no longer supplies electrical power to the hubbed motor 30 and starts supplying electrical power to the outside motor 40. The control module 22 is preferably a microprocessor based device, but other electronic devices may also be used. The clear disc 27 is retained between the retention ring 25 and peripheral flange 30. The clear disc 27 is preferably covers minute and hour hands, 58, 60. The clear disc preferably includes numeric indicia 74 for indicating time.

The control module 22 may be programmed to control the speed of the hubbed and geared spiral discs 12, 16, such that an adjustable period of time is created between the rotation of the hubbed spiral disc 12 relative to the geared spiral disc 16. The timepiece with rotating dial 1 may be implemented for both clocks and watches.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A timepiece with rotating dial comprising:

a spiral disc includes a slit;

a hubbed spiral disc includes a hubbed slit, said hubbed slit is inserted into said slit, wherein said spiral disc rotates relative to said hubbed spiral disc on the same axis;

a drive system directly rotates an outside perimeter of said spiral disc;

a hubbed drive system rotates said hubbed spiral disc; and a control module senses a position of said spiral disc and said hubbed spiral disc, said control module supplies electrical power to said drive system and said hubbed drive system depending upon the position of said spiral disc and said hubbed spiral disc.

2. The timepiece with rotating dial of claim 1, further comprising:

a timepiece housing for retaining said spiral disc, said hubbed spiral disc, said drive system, said hubbed drive system and said control module.

3. The timepiece with rotating dial of claim 1, further comprising:

a base mounting plate is attached to said timepiece housing, a clock mounting plate and an outside motor mounting plate are attached to said base mounting plate.

4. The timepiece with rotating dial of claim 1, further comprising:

a clear plate is located in front of said spiral disc and said hubbed spiral disc, said clear plate includes numeric indicia for indicating time.

5. The timepiece with rotating dial of claim 1 wherein:

said drive system includes an outside motor, a first outside drive gear, a second outside drive gear and an outside double-wide drive gear.

6. The timepiece with rotating dial of claim 1 wherein:

said hubbed drive system includes a hubbed motor, a hubbed drive gear and a central gear, said central gear is attached to said hubbed spiral disc.

7. The timepiece with rotating dial of claim 6, further comprising:

an outside magnet is mounted to said spiral disc, an inside magnet is mounted to said central gear, an outside sensor senses a position of said spiral disc through said outside magnet, an inside sensor senses a position of said hubbed spiral disc through said inside magnet.

8. A timepiece with rotating dial comprising:

a hubbed spiral disc includes a hubbed slit;

a geared spiral disc includes a geared slit and a geared outer perimeter, said hubbed slit is inserted into said geared slit, wherein said geared spiral disc rotates relative to said hubbed spiral disc on the same axis;

a hubbed drive system rotates said hubbed spiral disc;

an outside drive system rotates said geared spiral disc; and a control module senses a position of said hubbed spiral disc and said geared spiral disc, said control module supplies electrical power to said hubbed drive system and said outside drive system depending upon the position of said hubbed spiral disc and said geared spiral disc.

9. The timepiece with rotating dial of claim 8, further comprising:

a timepiece housing for retaining said geared spiral disc, said hubbed spiral disc, said geared drive system, said hubbed drive system and said control module.

10. The timepiece with rotating dial of claim 8, further comprising:

a base mounting plate is attached to said timepiece housing, a clock mounting plate and an outside motor mounting plate are attached to said base mounting plate.

11. The timepiece with rotating dial of claim 8, further comprising:

a clear plate is located in front of said geared spiral disc and said hubbed spiral disc, said clear plate includes numeric indicia for indicating time.

12. The timepiece with rotating dial of claim 8 wherein:

said outside drive system includes an outside motor, a first outside drive gear, a second outside drive gear and an outside double-wide drive gear.

13. The timepiece with rotating dial of claim 8 wherein:

said hubbed drive system includes a hubbed motor, a hubbed drive gear and a central gear, said central gear is attached to said hubbed spiral disc.

14. The timepiece with rotating dial of claim 13, further comprising:

an outside magnet is mounted to said geared spiral disc, an inside magnet is mounted to said central gear, an outside sensor senses a position of said geared spiral disc through said outside magnet, an inside sensor senses a position of said hubbed spiral disc through said inside magnet.

15. A timepiece with rotating dial comprising:

a hubbed spiral disc includes a hubbed slit;

a geared spiral disc includes a geared slit and a geared outer perimeter, said hubbed spiral disc is inserted into said geared slit, wherein said geared spiral disc rotates relative to said hubbed spiral disc on the same axis;

a hubbed drive system rotates said hubbed spiral disc;

an outside drive system rotates said geared spiral disc;

a control module senses a position of said hubbed spiral disc and said geared spiral disc, said control module supplies electrical power to said hubbed drive system and said outside drive system depending upon the position of said hubbed spiral disc and said geared spiral disc; and a clock module includes a minute hand and a hour hand, said minute hand and said hour are positioned in front of said hubbed spiral disc and said geared spiral disc.

16. The timepiece with rotating dial of claim 15, further comprising:

a timepiece housing for retaining said geared spiral disc, said hubbed spiral disc, said geared drive system, said hubbed drive system and said control module.

17. The timepiece with rotating dial of claim 15, further comprising:

a base mounting plate is attached to said timepiece housing, a clock mounting plate and an outside motor mounting plate are attached to said base mounting plate.

18. The timepiece with rotating dial of claim 15, further comprising:

a clear plate is located in front of said geared spiral disc and said hubbed spiral disc, said clear plate includes numeric indicia for indicating time.

19. The timepiece with rotating dial of claim 15 wherein:

said outside drive system includes an outside motor, a first outside drive gear, a second outside drive gear and an outside double-wide drive gear.

20. The timepiece with rotating dial of claim 15 wherein:

said hubbed drive system includes a hubbed motor, a hubbed drive gear and a central gear, said central gear is attached to said hubbed spiral disc.

* * * * *